US008358800B2

(12) United States Patent
Wu et al.

(10) Patent No.: US 8,358,800 B2
(45) Date of Patent: Jan. 22, 2013

(54) EARPHONE WITH ADJUSTABLE PLUG

(75) Inventors: Wei Wu, Shenzhen (CN); Xin Yang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 428 days.

(21) Appl. No.: 12/699,826

(22) Filed: Feb. 3, 2010

(65) Prior Publication Data

US 2011/0026755 A1 Feb. 3, 2011

(30) Foreign Application Priority Data

Jul. 30, 2009 (CN) ..... 2009 1 0305008

(51) Int. Cl.
*H04R 25/00* (2006.01)

(52) U.S. Cl. ..... 381/384; 381/379

(58) Field of Classification Search ..... 381/384, 381/124, 71.1; 439/668, 660, 584, 164
See application file for complete search history.

(56) References Cited

U.S. PATENT DOCUMENTS

| | | | | |
|---|---|---|---|---|
| 6,848,940 | B2 * | 2/2005 | Montena | 439/584 |
| 8,041,047 | B2 * | 10/2011 | Matsumoto et al. | 381/71.1 |
| 2003/0073348 | A1 * | 4/2003 | Ries et al. | 439/578 |
| 2007/0076907 | A1 * | 4/2007 | Stagni et al. | 381/124 |
| 2008/0003853 | A1 * | 1/2008 | Tanaka et al. | 439/164 |
| 2009/0004923 | A1 * | 1/2009 | Tang et al. | 439/660 |

* cited by examiner

*Primary Examiner* — Duc Nguyen
*Assistant Examiner* — Phan Le
(74) *Attorney, Agent, or Firm* — Altis Law Group, Inc.

(57) ABSTRACT

An earphone comprises two earbuds, a plug assembly, and a wire connected to the earbuds and the plug assembly. The plug assembly comprises a first insulation shell, a second insulation shell, an adjusting wheel located between the first insulation shell and the second insulation shell, a plug fixed in the inside of the first insulation shell, two stopping blocks fixed to one side of the first insulation shell away from the wire, and a resetting element received in the second insulation shell. The plug comprises a plug core and a sleeve set on the outside of the plug core.

12 Claims, 8 Drawing Sheets

EARPHONE WITH ADJUSTABLE PLUG

BACKGROUND

1. Technical Field

The present disclosure relates to an earphone with an adjustable plug.

2. Description of Related Art

Generally, there are two different earphone plug sizes, depending on the device that uses them, 3.5 mm and 2.5 mm. When users want to switch from listening to one device to another device, they may need to switch earphones as well.

Therefore, what is needed is an earphone plug to overcome the described shortcoming.

DETAILED DESCRIPTION

Figure 1:
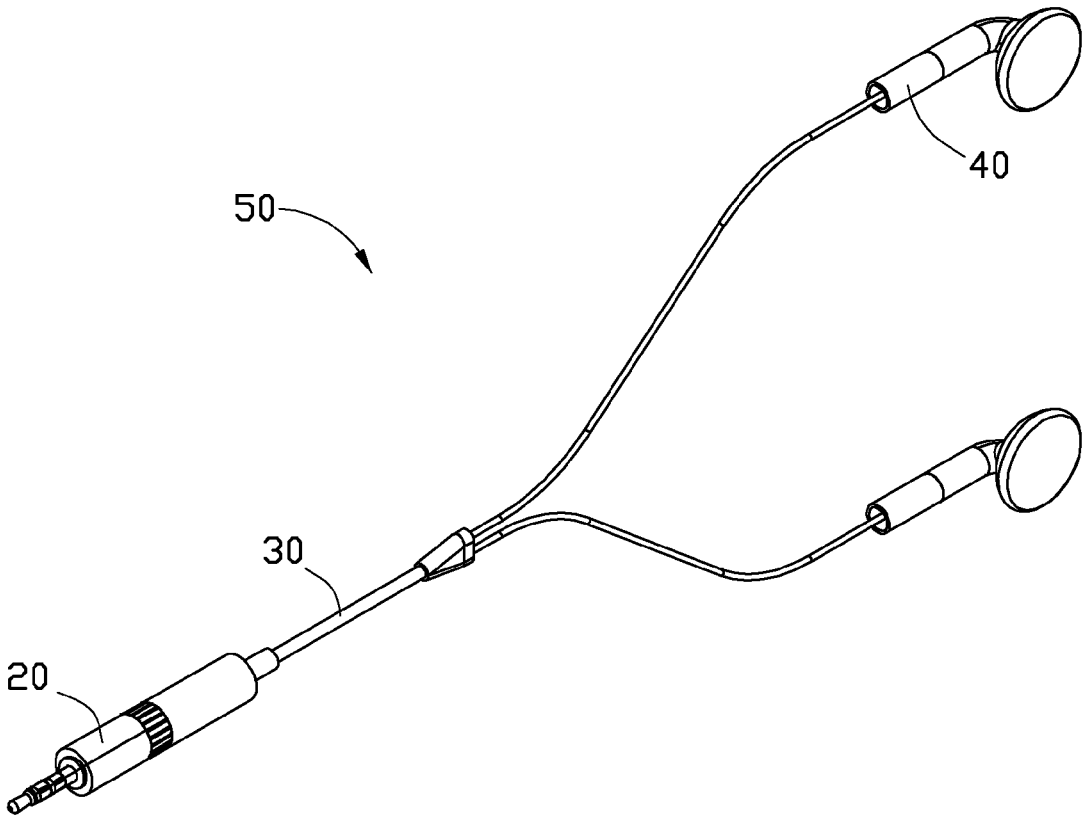
FIG. 1 is an isometric view of an earphone in a functional state in accordance with an exemplary embodiment.

Referring to FIG. 1, an earphone 50 is provided. The earphone 50 includes two earbuds 40, a plug assembly 20, and a wire 30 connecting the earbuds 40 to the plug assembly 20. The plug assembly 20 is configured to electronically connect to an audio interface (not shown) of an audio device (not shown), so that, audio signals from the audio device are transmitted to the earbuds 40 by the wire 30.

Figure 2:
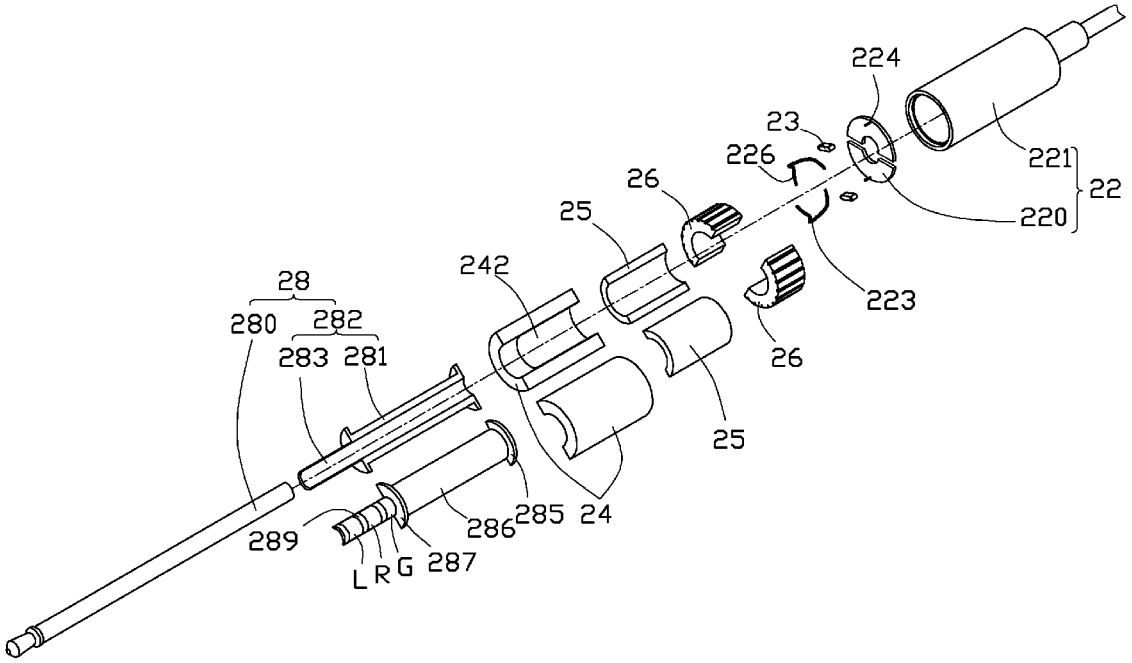
FIG. 2 is an exploded view of an earphone plug of FIG. 1.
Figure 3:
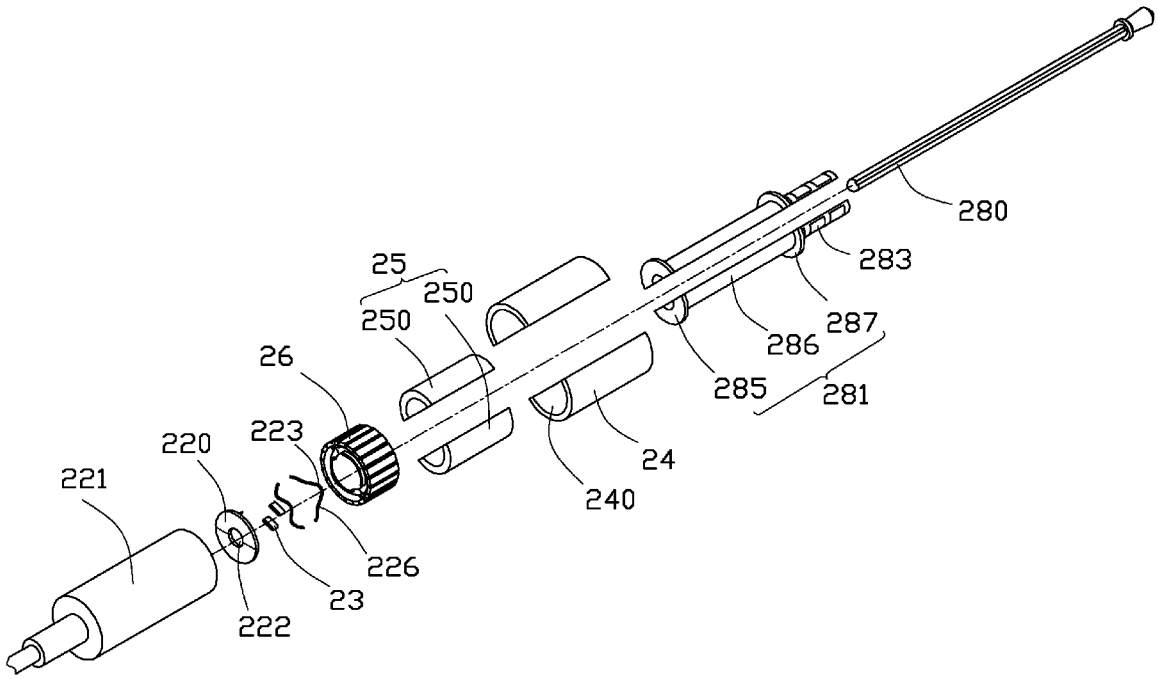
FIG. 3 is an exploded view of the earphone plug of FIG. 1, viewed from another aspect.

Referring to FIGS. 2-3, the plug assembly 20 includes a first insulation shell 22, a second insulation shell 24, an adjusting wheel 26, a plug 28, a stopping block 23, and a resetting element 25. The first insulation shell 22 and the second insulation shell 24 are cylindrical canisters. The first insulation shell 22 is fixed to one end of the wire 30. The adjusting wheel 26 is annular, and is located between the first insulation shell 22 and the second insulation shell 24. The plug 28 is fixed to the inside of the first insulation shell 22 and is connected to the wire 30. The plug 28 extends through the adjusting wheel 26, the second insulation shell 24, and is inserted into the audio interface of the audio device. The stopping block 23 is fixed to one side of the first insulation shell 22 away from the wire 30. The resetting element 25 is received in the second insulation shell 24.

The plug 28 includes a plug core 280 and a sleeve 282 set to sleeve and slide on the plug core 280. The adjusting wheel 26 cooperates with the stopping block 23 and the resetting element 25 to drive the sleeve 282 to join with or separate from the plug core 280, thereby changing the diameter of the plug 28 between two sizes to match the different specifications of the audio interface, such as, 2.5 mm/3.5 mm. For better understanding the disclosure, the following detailed description is provided.

The plug core 280 is a pole. One end of the plug core 280 is fixed to the first insulation shell 22 and is connected to the wire 30, and the other end of the plug core 280 is tapered.

The sleeve 282 includes two semi-cylindrical canisters, and is located in the outside of the plug core 280. The length of the sleeve 282 is less than that of the plug core 280, thereby exposing one end of the plug core 280 away from the first insulation shell 22. The sleeve 282 includes a limitation portion 281 and a plug portion 283 connected to the limitation portion 281. The limitation portion 281 can be attracted by an object with magnetic force. Two flanges 285, 287 are set in opposite ends of the limitation portion 281. A connection portion 286 connecting between the two flanges 285 and 287 is set in the limitation portion 281.

The plug portion 283 is connected to one end of the limitation portion 281 adjacent to the flange 287. The plug portion 283 includes an insulated body 289, a left channel contact portion L, a right channel contact portion R, and a grounding contact portion G. The left channel contact portion L, the right channel contact portion R, and the grounding contact portion G are of equal width axially and encircled to the insulated body 289, and are connected to the wire 30 by a conductor (not shown).

The first insulation shell 22 includes a receiving cavity 221 connected to the wire 30 and a fixing portion 220 fixed on the receiving cavity 221. The receiving cavity 221 is a hollow cylinder, and one end of the limitation portion 281 adjacent to the flange 285 is received in the receiving cavity 221. The fixing portion 220 is shaped like a washer and is composed of two semi-circular portions. A first through hole 222 is defined in the center of the fixing portion 220. The fixing portion 220 is placed over the connection portion 286, and is fixed to one end of the receiving cavity 221 away from the wire 30. The diameter of the first through hole 222 is less than the outer diameter of the flange 285, but exceeds the outer diameter of the connection portion 286, thereby limiting the end of the limitation portion 281 adjacent to the flange 285 in the inside of the first insulation shell 22.

Adjacent to the fixing portion 220 are two fixing poles 224 and two positioning components 226. The two fixing poles 224 are set at opposite edges of the fixing portion 220. The two positioning components 226 are located between the two fixing poles 224. A protrusion 223 is formed in a middle portion of each of the two positioning components 226. The two protrusions 223 are configured for generating an elastic deformation when receiving an exterior force, and rebounding when the exterior force is released.

Figure 4:
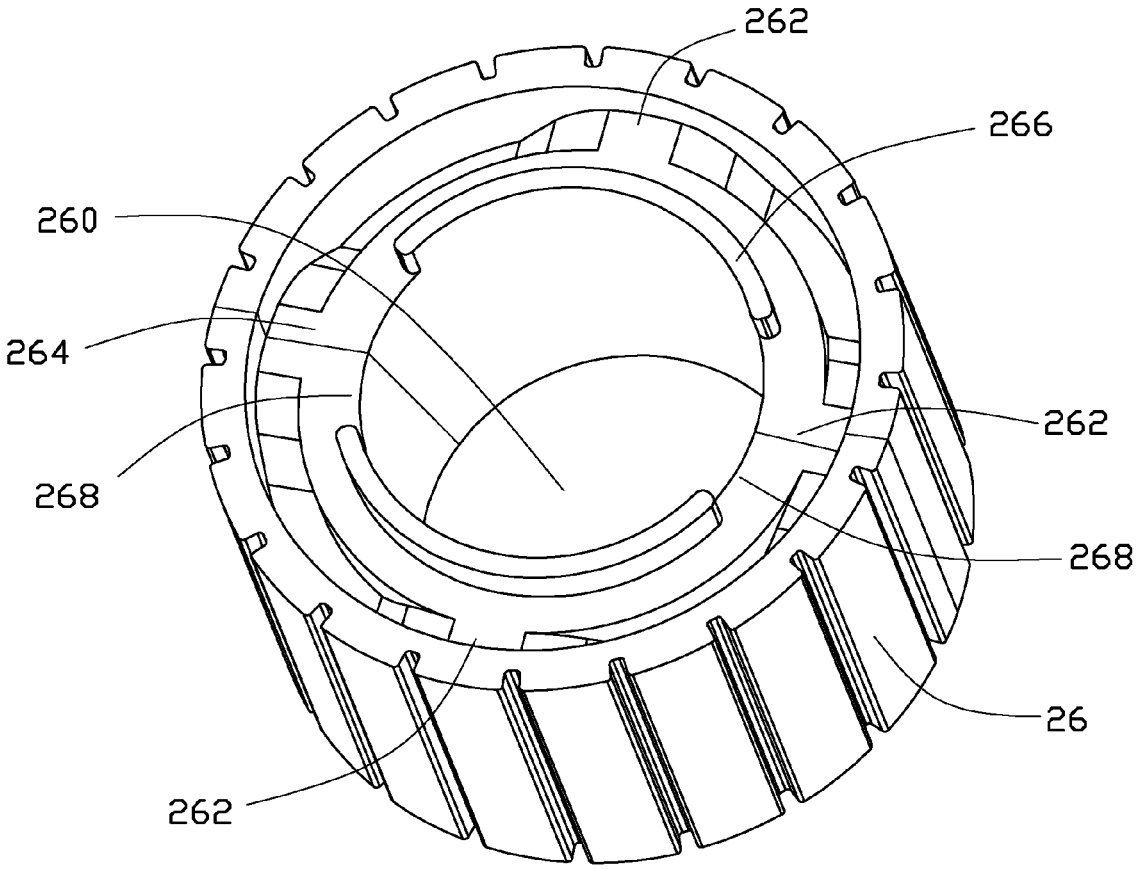
FIG. 4 is an isometric view of an adjusting wheel of the earphone plug of FIG. 1.
Figure 5:
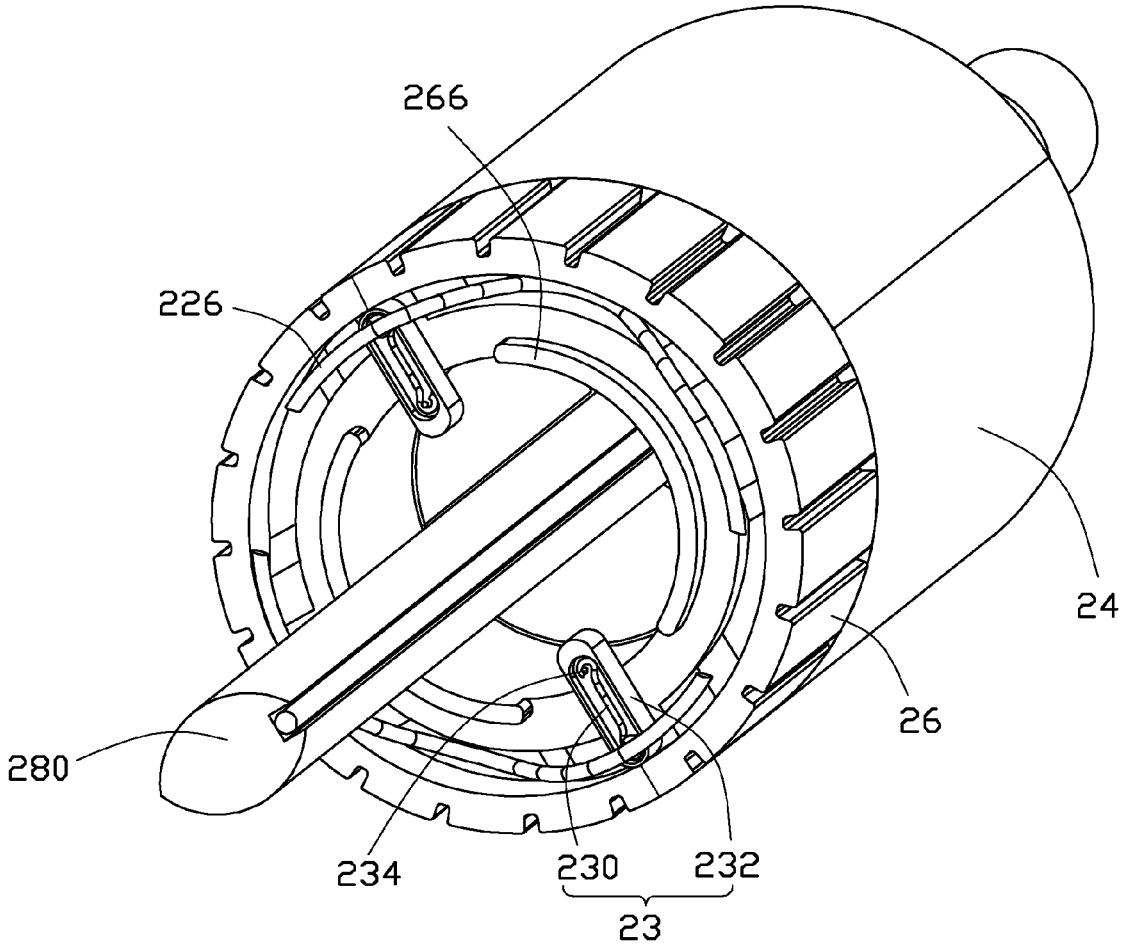
FIG. 5 is an isometric view of an earphone plug assembly of FIG. 1, with the exception of a first insulation shell and a sleeve.
Figure 6:
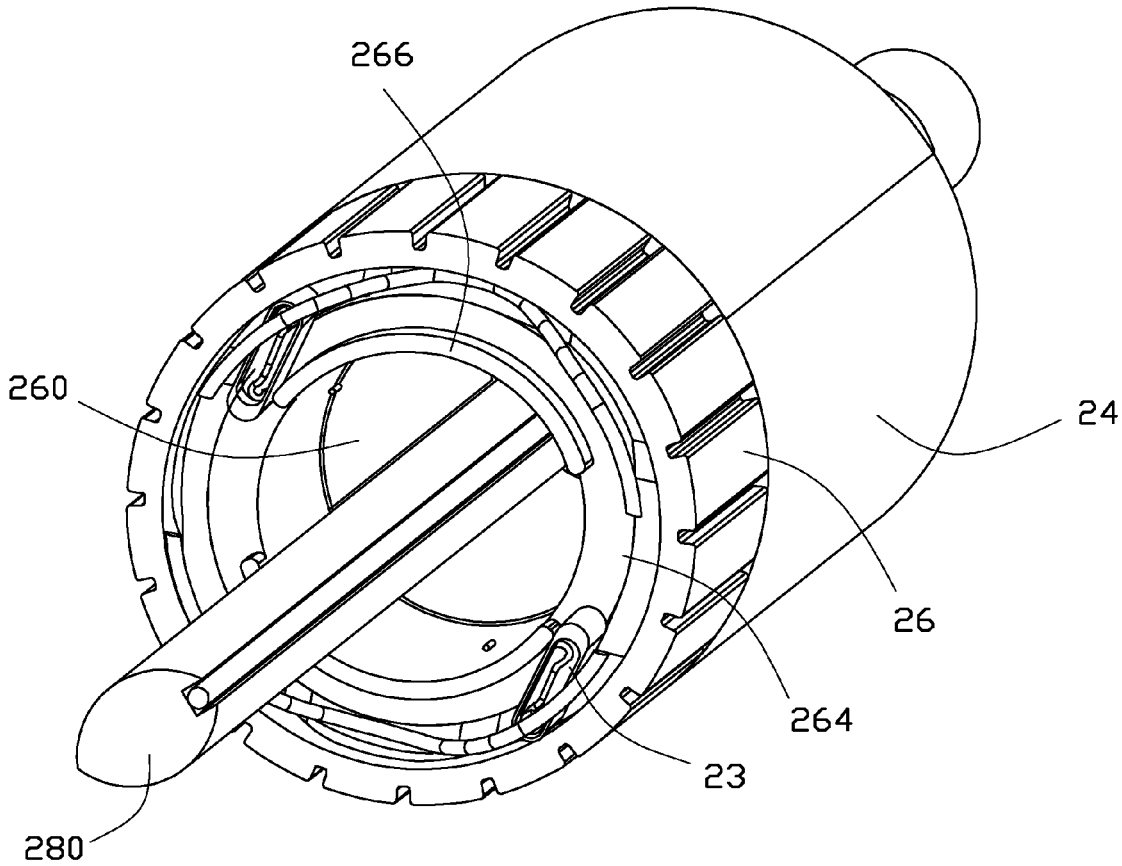
FIG. 6 is an isometric view of the earphone plug assembly of FIG. 5, in another functional state.

Referring to FIGS. 4-6, the stopping block 23 includes two stoppers 232 and two resetting springs 230. A second through hole (not shown) and a cylinder protrusion pole 234 are defined in opposite ends of each of the stoppers 232 respectively. The two fixing poles 224 are pivoted in the two second through holes of the stoppers 232, so that each stopper 232 is pivoted to the fixing portion 220 at one end. One end of each of the resetting springs 230 extends through the second through hole of the stopper 232 and is fixed to the fixing pole 224. Another end of each of the resetting springs 230 is fixed to the corresponding protrusion pole 234, thereby limiting the two resetting springs 230 between the fixing portion 220 and the stopper 232. The stopper 232 is placed in a radial direction of the fixing portion 220 by a force from the resetting spring 230. The two stoppers 232 are pivoted relative to the fixing portion 220 by an exterior force, thereby driving the two resetting springs 230 to generate an elastic deformation, and when the exterior force is released, the two resetting springs 230 resume the deformation to drive the two stoppers 232 to go back to the initial position.

The adjusting wheel 26 and the second insulation shell 24 are placed over the connection portion 286 of the limitation portion 281. The length of the connection portion 286 housed by the adjusting wheel 26 and the second insulation shell 24 equals that of the connection portion 286 exposed to the first insulation shell 22, thereby limiting the adjusting wheel 26 and the second insulation shell 24 between the fixing portion 220 and the flange 287.

The adjusting wheel 26 is located at one side of the fixing portion 220 and is formed by two semi-cylindrical annuluses. A third through hole 260 is defined in the center of the adjusting wheel 26. The adjusting wheel 26 is placed over the limitation portion 281 by connecting two semi-cylindrical annuluses. Four grooves 262 are equidistantly defined in one end of the adjusting wheel 26 adjacent to the fixing portion 220. An annular load-bearing body 264 is defined in one end of the adjusting wheel 26 located in the fixing portion 220. Two driving portions 266 are protruded from the circumference of the load-bearing body 264, so that, two cutouts 268 are formed between the two driving portions 266. The inner diameter of the load-bearing portion 264 exceeds the outer diameter of the connection portion 286, and the stopping block 23 pivoted to the fixing portion 220 is located between two driving portions 266, and is extended out of the cutouts 268 into the third through hole 260, and the two protrusions 223 are engaged in the two grooves 262. Accordingly, the adjusting wheel 26 is rotated relative to the fixing portion 220 by an exterior force, thereby driving the two driving portions 266 to move until the two driving portions 266 reach the stopping block 23 which is pivoted to the fixing portion 220.

When the adjusting wheel 26 is rotated relative to the fixing portion 220 by an exterior force, the two protrusions 223 will move from the two engaged grooves 262 to another two grooves 262 along the inner circumference of the adjusting wheel 26. During movement of the two protrusions 223 along the inner circumference of the adjusting wheel 26, the two protrusions 223 are compressed to generate an elastic deformation. When the protrusions 223 move to reach the other two grooves 262, the two protrusions 223 are released and rebound, thereby generating a resisting force to stop the adjusting wheel 26 from rotating. During rotation of the adjusting wheel 26, the two driving portions 266 of the adjusting wheel 26 act against the stopping block 23, thereby rotating the stopping block 23. When the adjusting wheel 26 receives a resisting force from the two protrusions 223, the stopping block 23 is stopped at one side of the driving portion 266 away from the sleeve 282, thereby avoiding the stopping block 23 to continually resist the limitation portion 281. The adjusting wheel 26 rotates until the two protrusions 223 are engaged in another set of grooves 262, the driving portions 266 are separated from the stopping block 23, and the two cutouts 268 act against the stopping block 23, thereby driving the stopping block 23 to rebound.

A fourth through hole 240 is defined in the center of the second insulation shell 24. The second insulation shell 24 is placed over the limitation portion 281 by connecting two semi-cylindrical canisters. The diameter of the fourth through hole 240 exceeds the outer diameter of the connection portion 286. The inner circumference of each of the two semi-cylindrical canisters is depressed towards the inside to form a concave portion 242 whose shape matches the shape of the resetting element 25. The resetting element 25 includes two semi-cylindrical magnets 250, each of which is embedded into the concave portion 242. Each of the two magnets 250 generates a magnetic force to attract the limitation portion 281, and the magnetic force is less than the resisting force for resisting the sleeve 282 from the stopping block 23. When the stopping block 23 resists the sleeve 282 to join the plug core 280, the sleeve 282 cannot be attracted by the two magnets 250. When the stopping block 23 does not resist the sleeve 282 to join the plug core 280, the sleeve 282 is attracted by the two magnets 250 to drive the sleeve 282 to separate from the plug core 280.

When assembling, firstly, the plug core 280 and the sleeve 282 are placed in the inside of the receiving cavity 221 of the first insulation shell 22, and the sleeve 282 is fixed to the receiving cavity 221; secondly, two semi-circular annuluses are connected to form the fixing portion 220 sleeved on the receiving cavity 221, thereby limiting the first insulation shell 22 by the flange 285 of the sleeve 282, and driving the connection portion 286, the flange 287 and the plug portion 283 to locate in the outside of the first insulation shell 22; thirdly, one end of the stopping block 23 is pivoted to the protrusion pole 224 of the fixing portion 220 by the second through hole, and another end of the stopping block 23 is located in the inside of the first through hole 222 for resisting the sleeve 282 to join the plug core 280; fourthly, the adjusting wheel 26 is placed over the connection portion 286 by connecting two semi-cylindrical canisters, and one end of the adjusting wheel 26 adjacent to the driving portion 266 is opposite to the fixing portion 220, and the stopping block 23 is located between two driving portions 266 and is passed through the two cutouts 268; finally, the second insulation shell 24 with the resetting element 25 is placed over the limitation body 281 by connecting two semi-cylindrical canisters, thereby limiting the second insulation shell 24 between the adjusting wheel 26 and the flange 287. For better understanding the disclosure, the following is a detailed description about the process of using the earphone 50.

Figure 7:
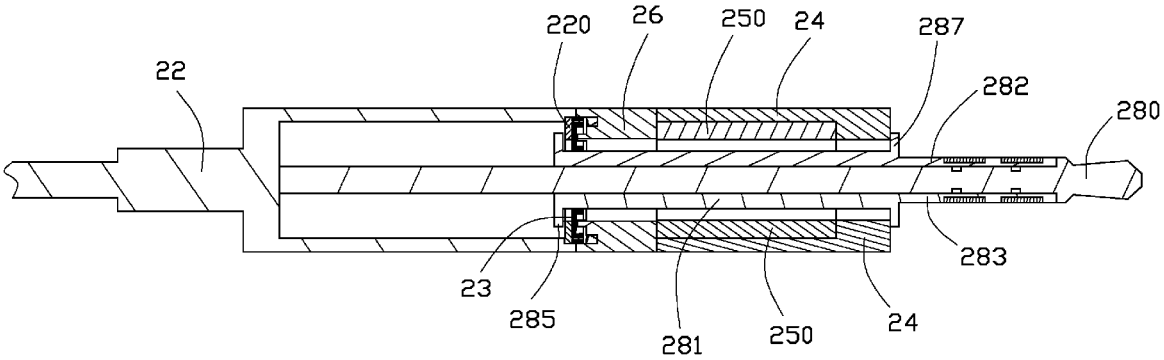
FIG. 7 is a cross-sectional view of the earphone plug assembly of FIG. 1.
Figure 8:
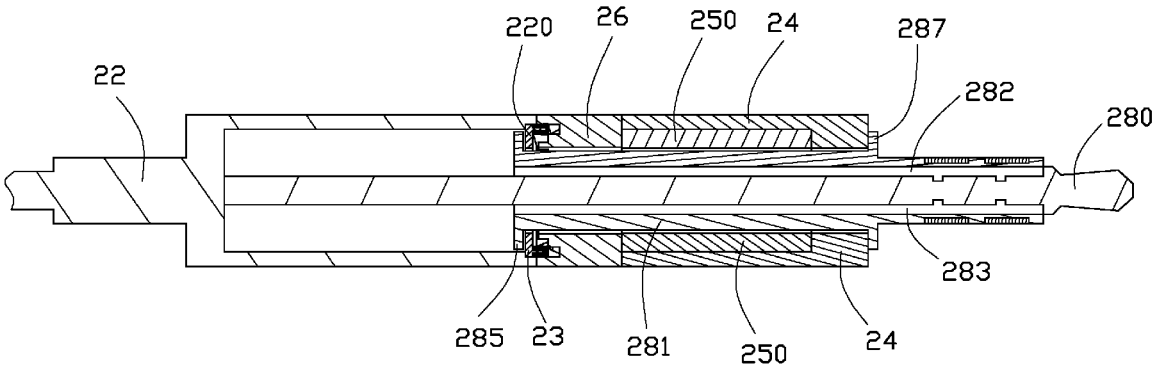
FIG. 8 is a cross-sectional view of the earphone plug assembly of FIG. 1, in another functional state.

Referring to FIGS. 7-8, when a user wants to insert the earphone 50 into an audio interface whose diameter is 3.5 mm, the user manipulates the adjusting wheel 26 to rotate relative to the fixing portion 220, so that, the two driving portions 266 located in the adjusting wheel 26 follow the adjusting wheel 26 to move to resist the stopping block 23, and the adjusting wheel 26 compresses the two protrusions 223 to generate an elastic deformation and when the protrusions 223 move to reach the other two grooves 262, the two protrusions 223 are released and rebound, thereby generating a resisting force to stop the adjusting wheel 26 from rotating. The stopping block 23 is stopped in one side of the driving portion 266 away from the sleeve 282, thereby preventing the stopping block 23 from continually resisting the limitation portion 281. The sleeve 282 is attracted by the resetting element 25 to separate from the plug core 280. That is, the diameter of the cross section of the plug 28 increases and matches the audio interface whose diameter is 3.5 mm.

When the user wants to insert the earphone 50 into an audio interface whose diameter is 2.5 mm, the user manipulates the adjusting wheel 26 to rotate relative to the fixing portion 220, and the two driving portions 266 follow the adjusting wheel 26 to rotate, and the adjusting wheel 26 compresses the two protrusions 223 to generate an elastic deformation and, when the protrusions 223 move to reach the other two grooves 262, the two protrusions 223 are released and rebound, thereby generating a resisting force to stop the adjusting wheel 26 from rotating. The stopping block 23 is separated from the two driving portions 266, and goes back to the initial position to resist the sleeve 282 by the elastic force from the two resetting springs 230. Because the resisting force from the stopping block 23 is greater than the magnetic force from the resetting element 25, thereby driving the sleeve 282 to separate from the resetting element 25, and to resist the plug core 280. That is, the diameter of the cross section of the plug 28 decreases, and matches the audio interface whose diameter is 2.5 mm.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. An earphone comprising:
two earbuds;
a plug assembly; and
a wire connected to the earbuds and the plug assembly;
the plug assembly comprising:
a first insulation shell;
a second insulation shell;
an adjusting wheel located between the first insulation shell and the second insulation shell;
a plug comprising a plug core and a sleeve, the plug core comprising a fixed end fixed to the first insulation shell and a free end protruding out of the second insulation shell, the sleeve comprising two semi-cylindrical canisters arranged around the plug core, the two semi-cylindrical canisters being movable in a radial direction of the plug core;
two stopping blocks pivotally mounted to one side of the first insulation shell away from the wire, each one of the two stopping blocks being rotatable between a first position where the one of the two stopping blocks abuts against one of the two semi-cylindrical canisters, causing the two semi-cylindrical canisters to abut against the plug core, and a second position where the one of the two stopping blocks disengage from the one of the two semi-cylindrical canisters; and
a resetting element received in the second insulation shell and configured to cause the two semi-cylindrical canisters to be spaced apart from the plug core when the two stopping blocks disengage from the two semi-cylindrical canisters;
wherein, the adjusting wheel is operable to rotate relative to the plug by an exterior force to drive the stopping blocks to rotate to the second position, enabling an external diameter of the sleeve to change from a first value to a second value greater than the first value.

2. The earphone as described in claim 1, wherein the resetting element is a magnet the is configured to attract the two semi-cylindrical canisters such that the two semi-cylindrical canisters are able to be spaced apart from the plug core when the two stopping blocks disengage from the two semi-cylindrical canisters.

3. The earphone as described in claim 2, wherein an annular load-bearing body is defined at one end of the adjusting wheel, and two driving portions protrude from an end of the load-bearing body, and when the adjusting wheel is rotated by the exterior force, the two driving portions act against the two stopping blocks, causing the two stopping blocks to rotate and push the two semi-cylindrical canisters to move toward the plug core.

4. The earphone as described in claim 3, wherein each of the two stopping blocks comprises a stopper and a resetting spring set in the stopper, one end of the stopper is pivotably connected to the first insulation shell, and an opposite end of the stopper is configured for pushing one of the two stopping blocks, the resetting spring is configured to push the stopper to return to an original position thereof, such that the two stopping blocks are able to rotate from the second position to the first position.

5. The earphone as described in claim 4, wherein the first insulation shell comprises a fixing portion comprising two fixing poles thereon for pivotally mounting the stopping blocks and fixing the resetting springs, the plug assembly further comprises two positioning components, a protrusion is formed in a middle portion of each positioning component, the protrusion is configured for generating an elastic deformation by an exterior force, and four grooves are equidistantly defined in one end of the adjusting wheel adjacent to the fixing portion, the protrusion is engaged in one of grooves, and during rotation of the adjusting wheel, the groove is separated from the protrusion, and the protrusion is compressed to generate an elastic deformation, and when the protrusion moves to reach another groove, the protrusion is released and rebounds, and is engaged in the another groove.

6. An earphone with two earphone specifications comprising:
two earbuds;
a plug assembly; and
a wire connected to the earbuds and the plug assembly;
the plug assembly comprising:
a driving component;
an insulation shell; and
a plug extending through the insulation shell, and the plug comprising a plug core and a sleeve set on an outside of the plug core, the plug core being fixed to one-end of the insulation shell, the sleeve comprising two semi-cylindrical canister arranged around the plug core, and the two semi-cylindrical canisters being movable in a radial direction of the plug core;
wherein, the driving component is configured for driving the sleeve to resist against the plug core or driving the sleeve to separate from the plug core, enabling an external diameter of the sleeve to change between a first value and a second value greater than the first value.

7. The earphone as described in claim 6, wherein the insulation shell comprises a first insulation shell and a second insulation shell, and the driving component comprises an adjusting wheel located between the first insulation shell and the second insulation shell, two stopping blocks pivotally mounted to one side of the first insulation shell, each one of the two stopping blocks being rotatable between a first position where the one of the two stopping blocks abuts against one of the two semi-cylindrical canisters, causing the two semi-cylindrical canisters to abut against the plug core, and a second position where the one of the two stopping blocks disengage from the one of the two semi-cylindrical canisters, and a resetting element received in the second insulation shell and configured to cause the two semi-cylindrical canisters to be spaced apart from the plug core when the two stopping blocks disengage from the two semi-cylindrical canisters, the adjusting wheel is operable to rotate relative to the plug by an exterior force to drive the stopping block to rotate to the second position, enabling an external diameter of the sleeve to change from the first value to the second value.

8. The earphone as described in claim 7, wherein the resetting element is a magnet that is configured to attract the two semi-cylindrical such that the two semi-cylindrical canisters area able to be spaced apart from the plug core when the two stopping blocks disengage from the two semi-cylindrical canisters.

9. The earphone as described in claim 8, wherein an annular load-bearing body is defined at one end of the adjusting wheel, and two driving portions protrude from an end of the load-bearing body, and when the adjusting wheel is rotated by the exterior force, the two driving portions act against the two stopping blocks, causing the two stopping blocks to rotate and push the two semi-cylindrical canisters to move toward the plug core.

10. The earphone as described in claim 9, wherein each of the two stopping blocks comprises a stopper and a resetting spring set in the stopper, one end of the stopper is pivotably connected to the first insulation shell, and an opposite end of the stopper is configured for pushing one of the two stopping blocks, the resetting spring is configured to push the stopper to return to an original position thereof, such that the two stopping blocks are able to rotate from the second position to the first position.

11. The earphone as described in claim 10, wherein the first insulation shell comprises a fixing portion comprising two fixing poles thereon for pivotally mounting the stopping blocks and fixing the resetting springs, the plug assembly further comprises two positioning components, a protrusion is formed in a middle portion of each positioning component, the protrusion is configured for generating an elastic deformation by an exterior force, and four grooves are equidistantly defined in one end of the adjusting wheel adjacent to the fixing portion, the protrusion is engaged in one of grooves, and during rotation of the adjusting wheel, the groove is separated from the protrusion, and the protrusion is compressed to generate an elastic deformation, and when the protrusion moves to reach another groove, the protrusion is released, and rebounds, and is engaged in the another groove.

12. The earphone as described in claim 6, wherein the first earphone specification is 2.5 mm, and the second specification is 3.5 mm.

* * * * *